US008531061B2

(12) United States Patent
Lim

(10) Patent No.: US 8,531,061 B2
(45) Date of Patent: Sep. 10, 2013

(54) PLUG DEVICE FOR CONTROLLING CONNECTION WITH POWER SOURCE

(75) Inventor: Seong-Kyu Lim, Daegu (KR)

(73) Assignee: Seong Kyu Lim, Daegu (KR)

( * ) Notice: Subject to any disclaimer, the term of this patent is extended or adjusted under 35 U.S.C. 154(b) by 281 days.

(21) Appl. No.: 12/666,931

(22) PCT Filed: Jun. 24, 2008

(86) PCT No.: PCT/KR2008/003590

§ 371 (c)(1),
(2), (4) Date: Dec. 28, 2009

(87) PCT Pub. No.: WO2009/002076

PCT Pub. Date: Dec. 31, 2008

(65) Prior Publication Data

US 2010/0148591 A1 Jun. 17, 2010

(30) Foreign Application Priority Data

Jun. 27, 2007 (KR) ..... 10-2007-0063507

(51) Int. Cl.
*H02H 3/12* (2006.01)

(52) U.S. Cl.
USPC ..... 307/125; 307/131

(58) Field of Classification Search
USPC ..... 307/125, 131
See application file for complete search history.

(56) References Cited

U.S. PATENT DOCUMENTS 5,475,609 A * 12/1995 Apothaker ..... 700/292
5,627,717 A * 5/1997 Pein et al. ..... 361/95
6,211,581 B1 * 4/2001 Farrant ..... 307/117
6,496,390 B2 * 12/2002 Yang ..... 363/21.07
6,552,888 B2 * 4/2003 Weinberger ..... 361/57
6,574,482 B1 * 6/2003 Radomsky et al. ..... 455/517
6,917,506 B2 * 7/2005 Chou ..... 361/191
7,209,116 B2 * 4/2007 Gates et al. ..... 345/156
7,639,907 B2 * 12/2009 Elberbaum ..... 385/24
7,663,866 B2 * 2/2010 Lee et al. ..... 361/601

(Continued)

FOREIGN PATENT DOCUMENTS

JP 10211142 A * 8/1998
KR 1020040067165 7/2004

(Continued)

OTHER PUBLICATIONS

International Search Report dated Dec. 22, 2008 for PCT application No. PCT/KR2008/003590.

*Primary Examiner* — Adi Amrany

(74) *Attorney, Agent, or Firm* — Lowe Hauptman & Ham LLP

(57) ABSTRACT

The present invention relates to a plug device, which can control the power source of an electrical product using a plug of the electrical product. The plug device includes a plug control circuit unit embedded in a plug main body of an electrical product, which is inserted in a power source outlet. The plug control circuit unit includes a switching unit coupled to internal power source lines of the plug control circuit unit, a current detection unit for detecting a current flowing from the internal power source lines to the electrical product, a wireless unit for receiving an external plug control wireless signal, and a controller for checking a current value corresponding to a non-operation of the electrical product and controlling the switching unit to switch on or off according to the checking result.

6 Claims, 3 Drawing Sheets

(56) References Cited

U.S. PATENT DOCUMENTS

| | | | | |
|---|---|---|---|---|
| 7,701,086 | B2 * | 4/2010 | McClurkan | 307/38 |
| 7,800,251 | B2 * | 9/2010 | Hodges et al. | 307/126 |
| 7,830,041 | B2 * | 11/2010 | Yang et al. | 307/115 |
| 7,843,081 | B2 * | 11/2010 | Lim | 307/39 |
| 7,944,086 | B2 * | 5/2011 | Hodges et al. | 307/31 |
| 7,961,111 | B2 * | 6/2011 | Tinaphong et al. | 340/638 |
| 8,031,270 | B1 * | 10/2011 | Wisniewski et al. | 348/734 |
| 2002/0185916 | A1 * | 12/2002 | Barton et al. | 307/38 |
| 2003/0042796 | A1 * | 3/2003 | Siu | 307/39 |
| 2005/0078087 | A1 * | 4/2005 | Gates et al. | 345/163 |
| 2005/0101314 | A1 * | 5/2005 | Levi | 455/423 |
| 2005/0111154 | A1 * | 5/2005 | Baughan | 361/93.1 |
| 2008/0164768 | A1 * | 7/2008 | Litwack | 307/116 |
| 2008/0309164 | A1 * | 12/2008 | Lim | 307/39 |
| 2010/0264008 | A1 * | 10/2010 | Kim | 200/52 R |

FOREIGN PATENT DOCUMENTS

| | | |
|---|---|---|
| KR | 20-0362673 | 9/2004 |
| KR | 20-0428011 | 10/2006 |
| KR | 1020070056893 | 6/2007 |

* cited by examiner

PLUG DEVICE FOR CONTROLLING CONNECTION WITH POWER SOURCE

CROSS REFERENCE TO RELATED APPLICATION

This application claims the priority of Korean Patent Application No. 10-2007-0063507, filed on Jun. 27, 2007 in the KIPO (Korean Intellectual Property Office), the disclosure of which is incorporated herein in their entirety by reference. Further, this application is the National Phase application of International Application No. PCT/KR2008/003590, filed Jun. 24, 2008, which designates the United States and was published in English. Each of these applications is hereby incorporated by reference in their entirety into the present application.

TECHNICAL FIELD

The present invention relates to a power source control device, and more particularly, to a plug device, which can control the power source of an electrical product using a plug of the electrical product.

BACKGROUND ART

In general homes or offices, electrical appliances (for example, computing devices, home appliances, electro-thermic appliances, kitchen appliances, etc.), which require a power source, have plugs inserted in a main power source outlet installed in a wall or a connector outlet extending from the main power source outlet and are supplied with operating power source.

In the past, when electrical and electronic goods are not used, the plugs of the goods are frequently pulled out from the power source outlet. It is very burdensome to pull out the plugs one by one from the power source outlet. These days, it is a daily event that the plug of an electrical product is inserted in a main power source outlet, a connector outlet (a multi-outlet) or the like. Accordingly, the electrical product having the plug inserted in the power source outlet consumes current even when they do not operate, thus causing its electronic circuits to be deteriorated.

If a user can interrupt the supply of the power source to an electrical product or supply the power source to the electrical product again without directly pulling out the plug of the electrical product, which is inserted in a corresponding power source outlet, or manually turning on/off a power switch of a connector outlet, energy can be saved and warm response will be gained from consumers.

DISCLOSURE OF INVENTION

Technical Problem

Accordingly, an object of the present invention is to provide a plug device that can control the power source to an electrical product through a plug of the electrical product inserted in a power source outlet.

Technical Solution

To achieve the above object, the present invention provides a plug device in which a plug control circuit unit is embedded in a plug main body of an electrical product, which is inserted in a power source outlet, wherein the plug control circuit unit senses a current corresponding to a power on/off state of the electrical product and selectively supplies a commercial AC power source to the electrical product or blocks the supply of the AC power source according to a time interval during which the sensed current is sustained and an external power-on request, and internal power source lines coupled to terminals of the plug main body are connected to power source supply lines of the electrical product. The plug control circuit unit includes a switching unit connected to the internal power source lines, a current detection unit for detecting a current flowing from the internal power source lines to the electrical product, a wireless unit for receiving an external plug control wireless signal, and a controller for, when a current value corresponding to a non-operation of the electrical product, which is being operated, is detected by the current detection unit, checking the non-operation state while monitoring the current detection unit during a first time interval and, when the non-operation state continues even after a Stand-by time interval while monitoring the current detection unit during a second time interval for verifying validity of the non-operation, controlling the switching unit to be switched off, wherein the controller controls the switching unit in response to the plug control wireless signal received through the wireless unit.

Further, the present invention provides a plug device, including a plug control circuit unit embedded in a plug main body of an electrical product, which is inserted in a power source outlet, wherein the plug control circuit unit senses a current corresponding to a power on/off state of the electrical product, checks a time interval during which the sensed current is sustained, selectively supplies a commercial AC power source to the electrical product or blocks the supply of the AC power source according to the time interval, and selectively supplies or blocks the commercial AC power source to the electrical product according to an external power-on request; and a remote control device including a Jog/shuttle dial and keypads having a power source control key and configured to transmit a plug remote control wireless signal to a plug main body of a corresponding electrical product when the power source control key is pressed after the Jog/shuttle dial is turned through the keypad, wherein marks corresponding to a plurality of electrical appliances to be controlled remotely are formed on a surface of the Jog/shuttle dial.

Advantageous Effects

As described above, the present invention is advantageous in that it can control fundamentally the power source supplied to an electrical product connected to a power source outlet using a plug of the electrical product.

MODE FOR THE INVENTION

Figure 1:
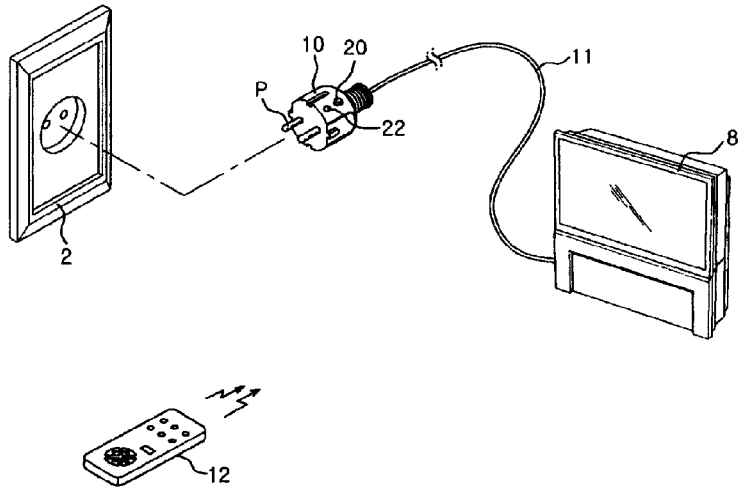
FIG. 1 shows the construction of a plug device in accordance with an embodiment of the present invention.

The present invention will now be described in detail in connection with preferred embodiments with reference to the accompanying drawings. It is to be noted that the same reference numerals designate the same elements although the elements are shown in different drawings. Further, detailed description on the known functions and constructions will be omitted if they are deemed to make the gist of the present invention unnecessarily vague.

Figure 2:
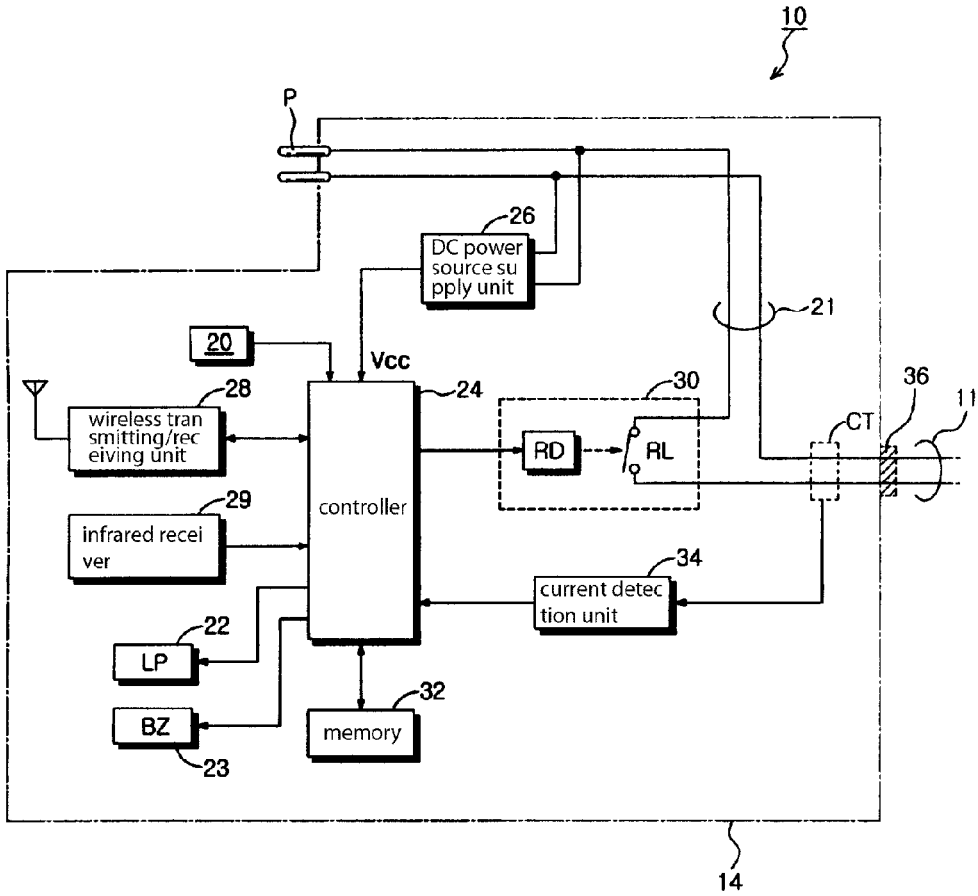
FIG. 2 is a block diagram of a plug control circuit unit built in a plug main body of FIG. 1.

FIG. 1 shows the construction of a plug device in accordance with an embodiment of the present invention. FIG. 2 is a block diagram of a plug control circuit unit 14 built in a plug main body 10 of FIG. 1.

The plug device in accordance with an embodiment of the present invention includes the plug control circuit unit 14 within a plug main body 10 and selectively includes a remote control device 12 that remotely controls the plug main body 10.

Referring to FIGS. 1 and 2 together, terminals P of the plug main body 10 in accordance with an embodiment of the present invention, which is connected to an electrical product 8 such as television, a computer, and an electric fan, are inserted in a power source outlet 2.

The plug main body 10 has the plug control circuit unit 14 as shown in FIG. 2 built therein. An electric wire-fastening portion 36 connects and fastens internal power source lines 21, coupled to the terminals P of the plug main body 10, to power source supply lines 11 of an electrical product. The electric wire-fastening portion 36 is selectively disposed within the plug main body 10 to thereby constitute the plug device. In the case in which a manufacturer of the electrical product 8 directly fabricates the plug device of the present invention, the power source supply lines 11 of the electrical product and the internal power source lines 21 are integrally coupled to each other. Thereafter, after the plug device of the present invention is fabricated, the power source supply lines 11 of the electrical product integrally connected to the internal power source lines 21 is coupled to the plug main body 10 of the plug device using the electric wire-fastening portion 36. Accordingly, the electric wire-fastening portion 36 can be used usefully when a user replaces an existing plug of the electrical product 8 with the plug main body 10 of the present invention.

The plug control circuit unit 14 of FIG. 2 determines a power-off state (when an operation of the electrical product 8 is stopped) and the time interval during which the electrical product 8 continues to operate according to an embodiment of the present invention and selectively stops the supply of the power source to the electrical product 8 based on the determination result. Further, the plug control circuit unit 14 of the plug main body 10 stops the supply of the power source to the electrical product 8 or supplies the power source to the electrical product 8 under the remote control of the remote control device 12.

An operating lamp 22, indicating whether the power source is supplied or not, and a button switch 20 for enabling a user to manually turn on/off the power source are provided on the outside of the plug main body 10. A buzzer (23 of FIG. 2) may also be built in the plug main body 10, if appropriate.

The plug control circuit unit 14 of FIG. 2 includes a controller 24, a DC power source supply unit 26, a wireless transmitting/receiving unit 28, a switching unit 30, memory 32, and a current detection unit 34. The plug control circuit unit 14 further includes the operating lamp 22, the button switch 20, and the buzzer 23 and may selectively include an infrared receiver 29.

The switching unit 30 includes a relay switch RL and a relay driver RD. The relay switch RL is coupled between one of the internal power source lines 21 coupled to the terminals P of the plug main body 10 and one of the power source supply lines 11 of the electrical product 8. The relay driver RD is driven under the control of the controller 24. Accordingly, the relay switch RL is switched under the control of the controller 24, thereby selectively forming a supply path of the commercial AC power source to a connector socket 6.

The wireless transmitting/receiving unit 28 is a block that transmits/receives a RF wireless control signal to/from an external remote control device 12 at a commercial frequency band. Further, the infrared receiver 29 is a wireless unit that receives an infrared signal transmitted from the remote control device 12.

The DC power source supply unit 26 converts the commercial AC power source into DC power source and supplies converted DC power source to the controller 24 and other circuit elements. The operating lamp 22 is disposed on the outside of the plug main body 10, as shown in FIG. 1, and is turned on or off under the control of the controller 24. The buzzer 23 selectively generates buzzer sound under the control of the controller 24. It is to be understood that the buzzer 23 can be substituted with voice guidance means using a voice guidance chip.

The memory 32 maps operating programs of the controller 24 and stores various data under the control of the controller 24.

Further, a current transformer (CT) of FIG. 2 surrounds and couples the internal power source lines 21 and transforms a magnetic field, which is generated when current flows through the internal power source lines 21, into current and outputs the transformed current to the current detection unit 34. The current detection unit 34 applies a voltage value, corresponding to the transformed current value, to the controller 24.

The controller 24 determines whether the electrical product 8 is operated based on a voltage value applied through the CT and the current detection unit 34. If, as a result of the determination, the electrical product 8 does not operate, the controller 24 turns off the switching unit 30 after a specific time interval (for example, several seconds) so that the AC power source is not applied to the electrical product 8. Further, the controller 24 controls the switching unit 30 in response to a switch remote control signal generated from the remote control device 12 in order to block or stop the supply of the AC power source. Furthermore, the controller 24 controls the switching unit 30 to turn on or off when a user presses the button switch 20.

Further, the controller 24 controls the operating lamp 22 to switch on or off in response to control of the supply of the power source and also selectively drives the buzzer 23. When the relay switch RL of the switching unit 30 switches on, the controller 24 controls the operating lamp 22 to switch on. When the switching unit 30 turns on or off, the controller 24 can control the buzzer 23 to generate buzzer sound for a short period of time.

Meanwhile, the remote control device 12 of FIG. 1 has a first remote control function of remotely controlling the plug main body 10 and can also have a second remote control function of remotely controlling the electrical product 8.

Figure 3:
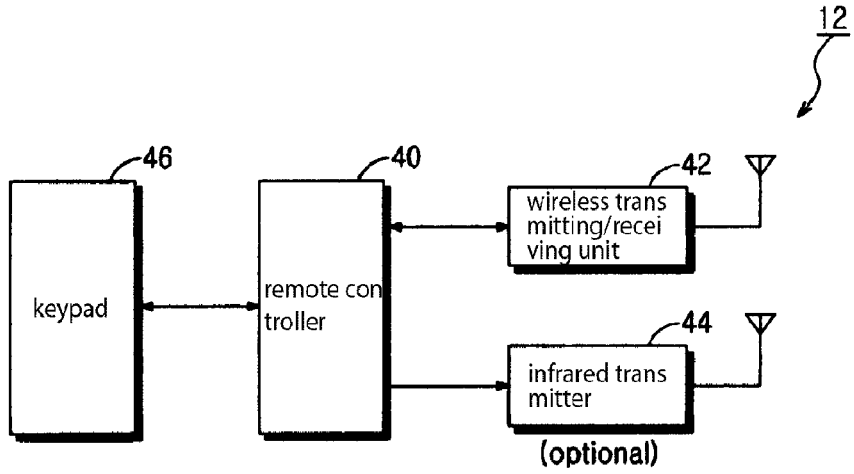
FIG. 3 is a circuit block diagram of a remote control device in the plug device of FIG. 1.

FIG. 3 is a circuit block diagram of the remote control device 12 in the plug device of FIG. 1.

Referring to FIG. 3, the remote control device 12 includes a remote controller 40, a wireless transmitting/receiving unit 42, an infrared transmitter 44, and a keypad 46.

The wireless transmitting/receiving unit 42 is a wireless unit for wirelessly transmitting/receiving signals to/from the plug main body 10 at a commercial frequency band under the control of the remote controller 40. The infrared transmitter 44 is a wireless unit that transmits an infrared signal, which remotely controls the electrical product 8 or the plug main body 10 under the control of the remote controller 40.

The keypad 46 of the remote control device 12 can be implemented in various ways. For example, the keypad 46 can be implemented to have a number of control keys, numeric keys, and direction keys in a general television or video remote controller, as illustrated in FIG. 1, or can be implemented to have a Jog/shuttle dial 50 as illustrated in FIG. 5.

Figure 5:
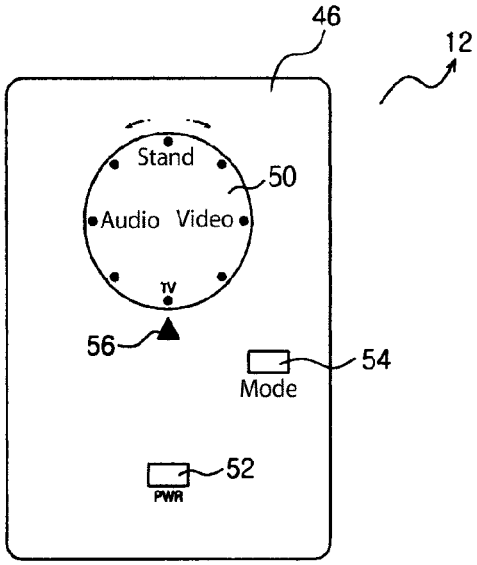
FIG. 5 shows the configuration of a keypad of the remote control device in accordance with another embodiment of the present invention.

The keypad 46 shown in FIG. 5 is an exemplary construction of a remote keypad which can be used at a hotel room where a number of electrical appliances exist.

Referring to FIG. 5, the keypad 46 of the remote control device 12 is equipped with the Jog/shuttle dial 50 for selecting various electrical appliances that will be turned on/off. The keypad 46 includes an on/off key 52 and a mode key 54. Symbols, indicating various electrical appliances to be remotely controlled, are formed on the surface of the Jog/shuttle dial 50. The mark can be a letter, an icon type or the like and can have a printed mark or a prominence and depression form.

Thus, when a user places an electrical product mark at a selection mark line 56 by turning the Jog/shuttle dial 50 and then presses the on/off key 52, the remote controller 40 recognizes such depression and transmits a corresponding wireless signal to the corresponding electrical product or the plug of the electrical product in a wireless manner. The mode key 54 is a mode key that can select RF wireless transmission and infrared transmission. A user can control the plug main body 10 by selecting one of the infrared transmission mode and the RF transmission mode using the mode key 54. Further, in the infrared transmission mode, the electrical product 8 can also be controlled.

Hereinafter, an operation in which a user operates the plug main body 10 of the electrical product 8 using the remote control device 12 is described in detail.

First, in the case in which the remote control device 12 is implemented to have the first remote control function (plug power source remote control) and the second remote control function (electrical product on/off remote control), an example of the operation of the remote control device 12 and the plug main body 10 is described below.

When a user powers on the remote control device 12 using the keypad 46, the remote controller 40 of the remote control device 12 in accordance with an embodiment of the present invention first controls the plug main body 10 to be powered on remotely through the wireless transmitting/receiving unit 42 and then controls a corresponding electrical product 8 to be powered on remotely through the infrared transmitter 44.

In the case in which the remote control device 12 is implemented to have the keypad 46 as shown in FIG. 5 and the mode key 54 is set to the infrared transmission mode, the remote control device 12 transmits a first infrared signal through the infrared transmitter 44 so that the plug main body 10 of a corresponding electrical product 8 is powered on and then transmits a second infrared signal through the infrared transmitter 44 so that the corresponding electrical product 8 is powered on. Further, if the mode key 54 is set to the RF transmission mode, the remote control device 12 first controls a corresponding plug main body 10 to be powered on remotely through the wireless transmitting/receiving unit 42 and then controls the corresponding electrical product 8 to be powered on remotely through the infrared transmitter 44.

In response thereto, the plug main body 10 turns on the switching unit 30 and then determines whether current corresponding to the power-on from the electrical product 8 has been detected through the current detection unit 34.

Next, in the case in which the remote control device 12 is implemented to have only the first remote control function (plug power source remote control), an example of the operation of the remote control device 12 and the plug main body 10 is described below.

When a user powers on the remote control device 12 using the keypad 46, the remote controller 40 of the remote control device 12 in accordance with an embodiment of the present invention controls the plug main body 10 to be powered on remotely through the wireless transmitting/receiving unit 42. In response thereto, the plug main body 10 switches on the switching unit 30 and determines whether current corresponding to the power-on from the electrical product 8 has been detected through the current detection unit 34.

In the case in which the remote control device 12 is implemented to have the keypad 46 as shown in FIG. 5 and the mode key 54 is set to the infrared transmission mode, when a user powers on the remote control device 12 using the keypad 46, the remote control device 12 transmits an infrared signal through the infrared transmitter 44 so that the plug main body 10 of a corresponding electrical product 8 is powered on.

Figure 4:
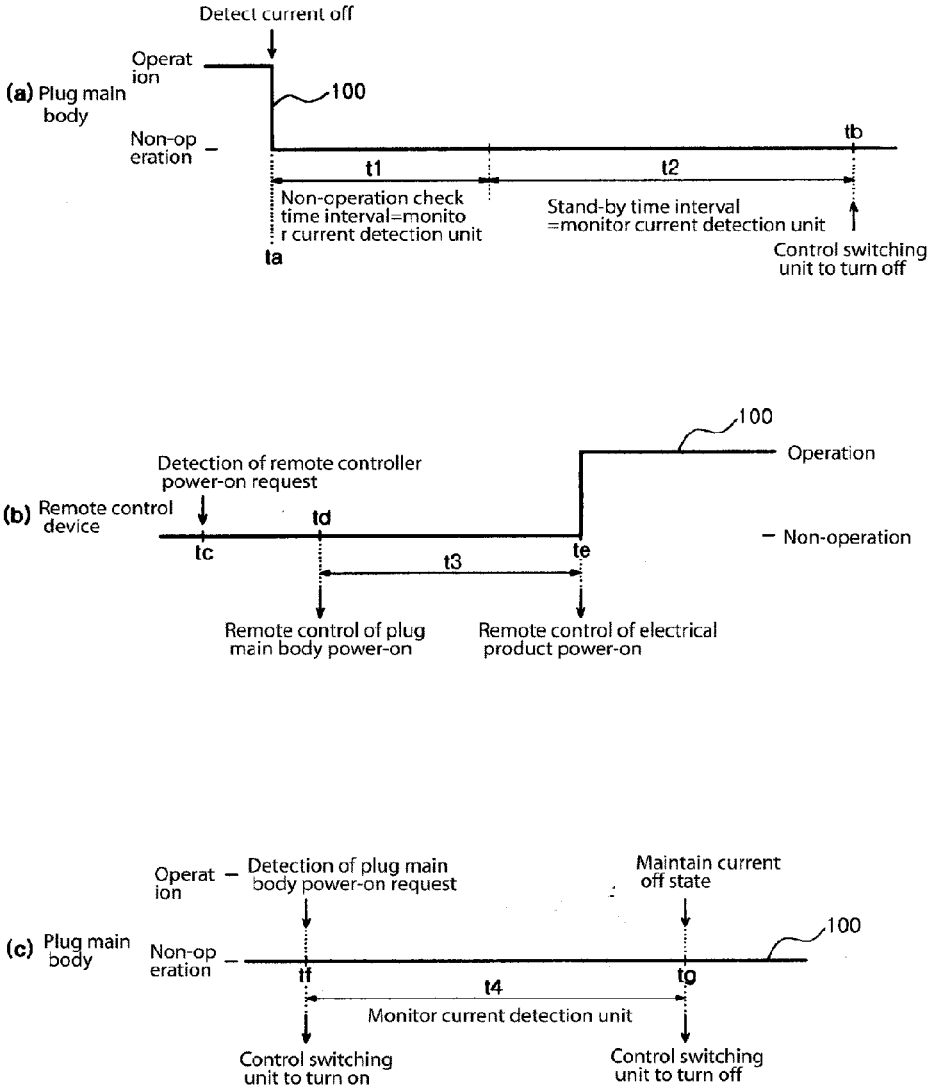
FIG. 4 is a timing diagram illustrating control in the plug device in accordance with an embodiment of the present invention.

FIG. 4 is a timing diagram illustrating control in the plug device in accordance with an embodiment of the present invention. (a) is a timing diagram illustrating control in the plug control circuit unit 14 of the plug main body 10 when the electrical product 8 being operated is powered off, (b) is a timing diagram illustrating control in the remote control device 12, and (c) is a timing diagram illustrating control in the plug control circuit unit 14 of the plug main body 10 when only the plug main body 10 is powered on.

In (a), (b), and (c) of FIG. 4, reference numeral '100' denotes a waveform showing operation (power-on) and non-operation (power-off) states of the electrical product 8.

The operation in the plug main body 10 in accordance with an embodiment of the present invention is described below in more detail with reference to FIG. 4.

When the electrical product 8 is not used, if a user inserts the plug main body 10 of the present invention, which is coupled to the power source supply lines 11 of the electrical product 8, in the power source outlet 2, the plug main body 10 fundamentally blocks the supply of the commercial AC power source to the electrical product 8.

More specifically, for example, when the electrical product 8 such as television is turned on, the controller 24 senses a voltage level corresponding to the operation of the electrical product 8 through the CT and the current detection unit 34 within the plug main body 10. Here, the operating lamp 22 of the plug main body 10 maintains a turn-on state under the control of the controller 24.

Thereafter, if a user turns off the electrical product 8, the controller 24 of the plug main body 10 senses a voltage level corresponding to the non-operation of the electrical product 8 through the CT and the current detection unit 34 (a time point 'ta' of FIG. 4).

In response thereto, the controller 24 determines whether the non-operation of the electrical product 8 has been normally detected while monitoring the output of the current detection unit 34 during a time interval t1 (for about 1 or 2 seconds), as shown in FIG. 4(*a*). If, as a result of the determination, the non-operation has been normally detected, the controller 24 continues to monitor the output of the current detection unit 34, while waiting for during a time interval t2 (for 5 to 9 seconds), in order to determine whether the non-operation is caused by external AC failure (an electricity failure for several seconds, on/off control of the electrical product for fun, etc.) (i.e., in order to verify the validity of the non-operation).

If the voltage level corresponding to the non-operation is continuously sensed even after the time interval t2 has elapsed, the controller 24 controls the switching unit 30 to turn off at a time point 'tp', so that the commercial AC power source supplied to the electrical product 8 is fundamentally blocked by the plug main body 10.

When the switching unit 30 is switched off, the controller 24 controls the operating lamp 22 of the plug main body 10 to turn off and also controls the buzzer 23 to generate short buzzer sound.

However, if the plug main body 10 senses a voltage level corresponding to an operation of the electrical product 8 during the time interval t1 or the time interval t2, the controller 24 controls the switching unit 30 of the plug main body 10 not to turn off, so the plug main body 10 continues to relay the supply of the commercial AC power source to the electrical product 8.

As described above, when the electrical product 8 is powered off, the plug main body 10 having the terminals inserted in the power source outlet 2 fundamentally blocks the supply of the commercial AC power source to the electrical product 8, thereby saving energy.

Meanwhile, in the state where the plug main body 10 fundamentally blocks the supply of the commercial AC power source, if it is sought to supply the commercial AC power source again, a user has only to use the switch button 20 of the plug main body 10 or the remote control device 12.

If a user presses the switch button 20 provided on the outer surface of the plug main body 10 or powers on the plug main body 10 using the remote control device 12 having only the first remote control function, the controller 24 recognizes the pressing of the switch button 20 or the power-on of the plug main body 10, and controls the switching unit 30 to be switched on, the operating lamp 22 to be turned on, and the buzzer 23 to generate short buzzer sound, for example, 'beep', which is different from that when the switching unit 30 is turned off.

In the case in which a user uses the remote control device 12, the controller 24 controls not only the plug main body 10, but also a corresponding electrical product 8 to turn on according to an embodiment of the present invention.

More specifically, if a user remotely powers on an electrical product using the keypad 46 of the remote control device 12, the remote controller 40 detects the power-on at a time point 'tc' shown in FIG. 4(*b*) and controls the plug main body 10 to be powered on remotely at a time point 'td' through the wireless transmitting/receiving unit 42. Thereafter, after a lapse of a time interval t3 (1 to 2 seconds), the remote controller 40 controls the electrical product 8 to be powered on remotely through the infrared transmitter 44 at a time point 'te'.

Accordingly, the plug main body 10 is powered on and thereafter the electrical product 8 is powered on. Consequently, the commercial AC power source can be supplied to the electrical product 8 through once remote control employing the remote control device 12.

Meanwhile, if a user presses the switch button 20 disposed on the outer surface of the plug main body 10 or powers on the plug main body 10 using the remote control device 12 having only the first remote control function, the plug control circuit unit 14 switches on the switching unit 30 of the plug main body 10, so that the commercial AC power source is supplied to the electrical product 8. However, if the electrical product 8 is turned off subsequently, the plug main body 10 senses this turn-off and blocks the supply of the commercial AC power source to the electrical product 8.

Referring to FIG. 4(*c*), if a user makes a plug power-on request at a time point 'tf' using the switch button 20 or the remote control device 12, the controller 24 of the plug main body 10 turns on the switching unit 30, so that a supply path of the commercial AC power source to the electrical product 8 via the plug main body 10 is established. Thereafter, the controller 24 determines whether a current value corresponding to the power-on of the electrical product 8 has been detected while monitoring the current detection unit 34 during a time interval t4 (for example, several seconds to several minutes). If, as a result of the determination, a current value corresponding to the power-on of the electrical product 8 has not been detected, the controller 24 controls the switching unit 30, which is in the turn-on state, to be turned off at a time point 'tg'. Thus, the supply of the commercial AC power source to the electrical product 8 through the plug main body 10 is blocked. However, if a voltage value corresponding to the operation of the electrical product 8 is detected while monitoring the current detection unit 34 during the time interval t4, the controller 24 of the plug main body 10 controls the switching unit 30 of the plug main body 10 not to turn off, so that the plug main body 10 continues to relay the commercial AC power source to the electrical product 8.

In this case, in the case in which a user powers on the plug main body 10 only, the plug main body 10 is automatically powered off after a lapse of a certain time interval, thereby saving energy.

This power-off within the plug main body 10 can obviate the consumption of stand-by power since the powers of remote control receivers embedded in electrical appliances, such as TV, audio devices, VCR, air conditioners, and electric fans, are always on. Further, if electrical appliances are controlled using the remote control device having the first remote control function and the second remote control function of the present invention, the plug main body and a corresponding electrical product can be powered on at the same time. Accordingly, a user does not feel inconvenient.

Further, power control within the plug main body of the present invention can be performed using only a simple and cheap multi-outlet without using a multi-outlet having a number of existing power switches.

The invention claimed is:

1. A plug device in which a plug control circuit unit is embedded in a plug main body of an electrical product, which is inserted in a power source outlet, wherein the plug control circuit unit senses a current corresponding to a power on/off state of the electrical product and selectively supplies an AC power source to the electrical product or blocks the supply of the AC power source according to a time interval during which the sensed current is sustained and an external power-on request, and internal power source lines coupled to terminals of the plug main body are connected to power source supply lines of the electrical product, wherein the plug control circuit unit comprises:

a switching unit connected to the internal power source lines;

a current transformer configured to surround and couple the internal power source lines for transforming a magnetic field, which is generated by a current flowing through the internal power source lines, into a current value;

a current detection unit configured to output a voltage value corresponding to the transformed current value;

a radio frequency (RF) wireless unit configured to receive an external plug control wireless signal for controlling transmission of the supply of power to the electrical product;

an infrared (IR) wireless unit configured to receive the external plug control wireless signal for controlling transmission of the supply of power to the electrical product;

a controller configured to control the switching unit based on the outputted voltage value or in response to the external plug control wireless signal received through one of the RF or IR wireless units, wherein when the outputted voltage value corresponds to a non-operation of the electrical product, the controller checks the non-operation state while monitoring the current detection unit during a first time interval, and after the first time interval, when the non-operation state is maintained during a second time interval for verifying validity of the non-operation, the controller controls the switching unit to be switched off; and a remote control device having a keypad, a remote RF wireless unit, a remote IR wireless unit, a mode switch, and a remote controller, wherein in response to the mode switch being set to an infrared transmission mode, the remote control device transmits a first IR signal to the plug main body and a second IR signal to the electrical product, and in response to the mode switch being set to an RF transmission mode, the remote control device transmits an RF signal to the plug main body and a third IR signal to the electrical product.

2. The plug device of claim 1, wherein if a voltage value corresponding to a non-operation state of the electrical product is outputted in the state where the AC power source is supplied to the electrical product through the plug main body according to a plug power-on request, the controller is configured to monitor the current detection unit during a third interval, and if the non-operation state is maintained, the controller is configured to control the switching unit to be switched off.

3. The plug device of claim 1, wherein the plug main body includes at least one of a buzzer and an operating lamp that are operated under the control of the controller.

4. A plug device comprising:

a plug control circuit unit embedded in a plug main body of an electrical product, which is inserted in a power source outlet, wherein the plug control circuit unit senses a current corresponding to a power on/off state of the electrical product, checks a time interval during which the sensed current is sustained, selectively supplies an AC power source to the electrical product or blocks the supply of the AC power source according to the time interval, and selectively supplies or blocks the AC power source to the electrical product according to an external power-on request; and a remote control device including a Jog/shuttle dial, a remote RF wireless unit, a remote IR wireless unit, a mode switch, a remote controller, and a keypad having a power source control key and configured to transmit an external plug control wireless signal to a plug main body of a corresponding electrical product when the power source control key is pressed after the Jog/shuttle dial is turned through the keypad, wherein marks corresponding to a plurality of electrical appliances to be controlled remotely are formed on a surface of the Jog/shuttle dial, wherein the plug control circuit unit comprises:

a switching unit connected to the internal power source lines;

a current transformer configured to surround and couple the internal power source lines for transforming a magnetic field, which is generated by a current flowing through the internal power source lines, into a current value;

a current detection unit configured to output a voltage value corresponding to the transformed current value;

a radio frequency (RF) wireless unit configured to receive the external plug control wireless signal for controlling transmission of the supply of power to the electrical product;

an infrared (IR) wireless unit configured to receive the external plug control wireless signal for controlling transmission of the supply of power to the electrical product; and a controller configured to control the switching unit based on the outputted voltage value or in response to the external plug control wireless signal received through one of the RF or IR wireless units, wherein when the outputted voltage value corresponds to a non-operation of the electrical product, the controller checks the non-operation state while monitoring the current detection unit during a first time interval, and after the first time interval, when the non-operation state is maintained during a second time interval for verifying validity of the non-operation, the controller controls the switching unit to be switched off, and wherein in response to the mode switch being set to an infrared transmission mode, the remote control device transmits a first IR signal to the plug main body and a second IR signal to the electrical product, and in response to the mode switch being set to an RF transmission mode, the remote control device transmits an RF signal to the plug main body and a third IR signal to the electrical product.

5. The plug device of claim 4, wherein if a voltage value corresponding to a non-operation state of the electrical product is outputted in the state where the AC power source is supplied to the electrical product through the plug main body according to a plug power-on request, the controller is configured to monitor the current detection unit during a fourth time interval, and if the non-operation state is maintained, the controller is configured to control the switching unit to be switched off.

6. The plug device of claim 4, wherein the plug main body includes at least one of a buzzer and an operating lamp that are operated under the control of the controller.

* * * * *